United States Patent [19]

Abel

[11] 4,448,874

[45] May 15, 1984

[54] POLYMERIC TIMING LAYER FOR COLOR TRANSFER ASSEMBLAGES

[75] Inventor: Edward P. Abel, Webster, N.Y.

[73] Assignee: Eastman Kodak Company, Rochester, N.Y.

[21] Appl. No.: 480,963

[22] Filed: Mar. 31, 1983

[51] Int. Cl.[3] ..... G03C 1/40; G03C 1/48; G03C 5/54; G03C 5/24

[52] U.S. Cl. ..... 430/215; 430/454; 428/522

[58] Field of Search ..... 430/215, 454; 428/522

[56] References Cited

U.S. PATENT DOCUMENTS

| | | | |
|---|---|---|---|
| 4,009,030 | 2/1977 | Abel | 430/215 |
| 4,056,394 | 11/1977 | Hannie | 430/215 |
| 4,061,496 | 12/1977 | Hannie et al. | 430/215 |
| 4,190,447 | 2/1980 | Coil et al. | 430/215 |
| 4,229,516 | 10/1980 | Abel | 430/215 |
| 4,379,829 | 4/1983 | Krafft et al. | 430/215 |

*Primary Examiner*—Richard L. Schilling
*Attorney, Agent, or Firm*—Harold E. Cole

[57] ABSTRACT

Photographic assemblages and cover sheets are described employing a timing layer comprising a physical mixture of the following two polymers:

(i) a first polymer comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride; and (ii) a second polymer comprising from about 20 to about 70 percent by weight of recurring units of maleic anhydride and from about 80 to about 30 percent by weight of recurring units of a vinyl ester or an alkene;

the second polymer being present at a concentration of from about 2 to about 20 percent by weight of the mixture.

23 Claims, No Drawings

POLYMERIC TIMING LAYER FOR COLOR TRANSFER ASSEMBLAGES

This invention relates to photography, and more particularly to photographic assemblages and cover sheets for color diffusion transfer photography wherein a timing layer comprising a mixture of certain polymers is employed. This timing layer has an activation energy which is intermediate those of the prior art and can be tailored to provide a desired timing layer breakdown (TLB) time. TLB is the penetration time of the timing layer by an alkaline processing composition.

Various formats for color, integral transfer elements are described in the prior art, such as U.S. Pat. Nos. 3,415,644; 3,415,645; 3,415,646; 3,647,437; 3,635,707; 3,756,815, and Canadian Patents 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 minutes or more in other formats. Since development occurs at a high pH, it is rapidly slowed by merely lowering the pH. The use of a neutralizing layer, such as a polymeric acid, can be employed for this purpose, which will stabilize the element after the required diffusion of dyes has taken place. A timing layer is usually employed in conjunction with the neutralizing layer, so that the pH is not prematurely lowered, which would stop or restrict development. The development time is thus established by the time it takes the alkaline composition to penetrate through the timing layer. As the system starts to become stabilized, alkali is depleted throughout the structure, causing silver halide development to substantially cease in response to this drop in pH. For each image generating unit, this shutoff mechanism establishes the amount of silver halide development and the related amount of dye formed according to the respective exposure values.

Timing layers comprising a polymeric latex of acrylonitrile, acrylic acid and vinylidene chloride are described in U.S. Pat. Nos. 4,056,394. The polymeric acid layer over which the timing layer is coated is usually coated from an organic solvent, however. This necessitates the use of different coating machines for the latex or aqueous coating and for the solvent coating. It would be desirable to provide a solvent coatable timing layer so that both the acid layer and the timing layer could be coated on the same coating machine in order to reduce manufacturing costs.

In column 3, lines 4–10 of that patent, reference is made to a cover sheet having a layer of poly(styrene-co-maleic anhydride) coated over an acid layer. An outer layer, such as the latex polymers described later on in the patent, is then coated on top in order to determine its activation energy, Ea, as defined therein. As will be shown by comparative tests hereinafter, poly(styrene-co-maleic anhydride) is not an effective timing layer as it is very permeable to alkali and thus has a very short TLB time. A solvent coating of poly(acrylonitrile-co-acrylic acid-co-vinylidene chloride) is not effective as a timing layer either, as it is virtually impermeable to alkaline processing composition. A mixture of the two polymers, however, in accordance with our invention, does provide a useful timing layer.

U.S. Pat. No. 4,009,030 relates to a timing layer comprising a mixture of cellulose acetate and a maleic anhydride copolymer. While this timing layer was found to be suitable for some applications, other systems required a timing layer with a higher Ea.

An improvement over the technology of the '030 patent is found in U.S. Pat. No. 4,061,496. That patent relates to the use of a combination of two timing layers. The first timing layer is a mixture of cellulose acetate and a maleic anhydride copolymer as described in the '030 patent discussed above. The second timing layer is a poly(acrylonitrile-co-acrylic acid-co-vinylidene chloride) latex polymer. It would be desirable to obtain the properties desired in a timing layer with one coating instead of two, however. Further, it would be desirable to avoid changing coating machines in order to coat an aqueous latex polymer on top of a solvent-coated timing layer and polymeric acid layer.

U.S. Pat. No. 4,190,447 describes the use of a hydrophilic layer over the poly(acrylonitrile-co-acrylic acid-co-vinylidene chloride) latex polymer described in the '394 patent discussed above. Included in the list of hydrophilic materials disclosed is a maleic anhydride copolymer. Again, however, it would be desirable to avoid having to change coating machines in order to coat an aqueous latex polymer on top of a solvent-coated polymer.

U.S. Pat. No. 4,229,516 describes a timimg layer comprising a physical mixture of two polymers: (1) a poly(acrylonitrile-co-acrylic acid-co-vinylidene chloride) and (2) a polymeric carboxy-ester-lactone. This mixture is coatable from organic solvents. However, the polymeric carboxy-ester lactone, produced by lactonization and esterification of poly(vinyl acetate-co-maleic anhydride) with n-butanol, is expensive and involves complex manufacturing procedures. A precisely specified lactonization and esterification is required and the resulting carboxyl content is dependent on the quantities of water and n-butanol used and the reaction conditions. It would be desirable to find a material to use instead of the polymeric carboxy ester lactone which would be cheaper and easier to synthesize, yet which would provide equivalent sensitometry in a photographic system, and which would still be solvent-coatable. These and other advantages are provided by my invention.

In accordance with my invention, there is provided a photographic assemblage comprising:

(a) a photosensitive element comprising a support having thereon at least one photosensitive silver halide emulsion layer having associated therewith a dye image-providing material;
(b) a dye image-receiving layer;
(c) a neutralizing layer for neutralizing an alkaline processing composition; and
(d) a timing layer located between the neutralizing layer and the dye image-receiving layer;

and wherein the timing layer comprises a physical mixture of the following two polymers:

(i) a first polymer comprising from about 5 to about 35 percent by weight of recurring units of an ethylenically unsaturated monomer, from about 0 to about 20 percent by weight of recurring unit of an ethylenically unsaturated carboxylic acid, and from about 55 to about 85 percent by weight of recurring units of vinylidene chloride; and
(ii) a second polymer comprising from about 20 to about 70 percent by weight of recurring units of maleic anhydride and from about 80 to about 30 percent by weight of recurring units of a vinyl ester or an alkene;

the second polymer being present at a concentration of from about 2 to about 20 percent by weight of the mixture.

Any ethylenically unsaturated monomer which is differnet from the other monomers in the polymer can be used to prepare the polymer described above including alkyl acrylates and methacrylates such as methyl acrylate, ethyl acrylate, propyl acrylate, butyl acrylate, or butyl methacrylate; vinyl esters, amides, nitriles, ketones, halides, ethers, olefins, or diolefins as exemplified by acrylonitrile, methacrylonitirle, styrene, $\alpha$-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalimide, N-vinylpyrrolidone, butadiene, or ethylene. A preferred monomer is acrylonitrile.

Examples of ethylenically unsaturated carboxylic acids which can be included in the polymer described above include acrylic acid, methacrylic acid, itaconic acid, fumaric acid, maleic acid, or their anhydrides. The preferred carboxylic acids are acrylic acid and itaconic acid.

Any vinyl ester can be used in the second polymer described above which is known in the art to copolymerize with maleic anhydride such as vinyl acetate, vinyl propionate, vinyl butyrate or vinyl benzoate. A preferred vinyl ester is vinyl acetate.

Any alkene can be used in the second polymer described above which is known in the art to copolymerize with maleic anhydride such as ethylene, styrene, propylene or butylene. A preferred alkene is ethylene or styrene.

In another preferred embodiment of my invention, the first polymer comprises from about 5 to about 35 percent by weight of recurring units of acrylonitrile, from about 2 to about 10 percent by weight of recurring units of acrylic acid, and from about 55 to about 85 percent by weight of recurring units of vinylidene chloride; and the second polymer comprises from about 20 to about 70 percent by weight of recurring units of maleic anhydride and from about 80 to about 30 percent by weight of recurring units of styrene. A preferred ratio of maleic anhydride to styrene is 50:50.

The vinylidene chloride polymer described above can be conveniently prepared by latex polymerization and then conversion to the solid polymer as described in U.S. Pat. No. 4,229,516, columns 5 and 6, the disclosure of which is hereby incorporated by reference. The maleic anhydride copolymers described above can be prepared by conventional techniques well known to those skilled in the art and are also commerically available.

The polymers employed in the timing layer of my invention are thus easier to manufacture and provide equivalent sensitometry to those of the prior art. Also, by varying the ratio of the various components of the polymer mixture, its Ea and TLB time can also be changed. This is advantageous in being able to "tailor" a particular timing layer to provide a desired photographic effect. For example, as less of the maleic anhydride copolymer is added to the mixture, a timing layer with a higher Ea will be produced and the TLB time will also increase.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2.756.142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Patent No. 602,607. In a preferred demobiment of this invention, the dye image providing material is a ballasted, redox-dye-releasing (RDR) compound. Such compounds are well known to those skilled in the art and are, generally speaking, compounds which will react with oxidized or unoxidized developing agent or electron transfer agent to release a dye. Such nondiffuxsible RDR'a include negative-working compounds, as described in U.S. Pat. Nos. 3,728,113 of Becker et al; 3,725,062 of Anderson and Lum; 3,698,897 and Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of this invention, positive-working quinone RDR's, are employed and the photographic element contains an incorporated reducing agent as described in U.S. Pat. No. 4,139,379 referred to above. In this embodiment, the positive-working quinone RDR compound as incorporated in a photographic element is incapable or releasing a diffusible dye. However, during photographic processing under alkaline conditions, the compound is capabe of accepting at least one electron (i.e., being reduced) and thereafter releases a diffusible dye. Further details are found in U.S. Pat. No. 4,139,379, the disclosure of which is hereby incorporated by reference.

In another preferred embodiment, the quinone RDR's have the formula:

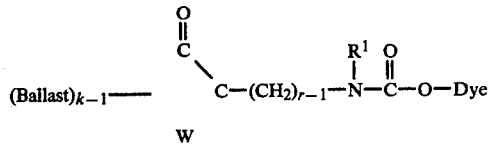

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 to 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is an organic dye or dye precursor moiety.

The photographic element in the above-described photographic assemblage is treated with an alkaline processing composition to effect or initiate development in any manner. One method for applying processing composition is by interjecting processing solution with communicating members similar to hypodermic syringes which are attached either to a camera or camera cartridge. The processing composition can also be applied by means of a swab or by dipping in a bath, if so desired. Another method of applying processing composition to a film assemblage which can be used in this invention is the liquid spreading means described in U.S. Application Ser. No. 143,230 of Columbus, filed Apr. 24, 1980, now abandoned.

In a preferred embodiment of the invention, the assemblage itself contains the alkaline processing composition and means containing same for discharge within the film unit. There can be employed, for example, a rupturable container which is adpated to be positioned during processing of the film unit so that a compressive force applied to the container by pressure-applying members, such as would be found in a camera designed for in-camers processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of the invention, the dye image-receiving element would comprise a support having thereon, in sequence, a neutralizing layer, a timing layer as described previously, and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above described film assemblage in another embodiment is located integral with the photographic element and is located between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon, a neutralizing layer and a timing layer, as previously described. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, photo-sensitive silver halide emulsion is coated on an opaque support and a dye image-receiving layer is located on a separate transparent support superposed over the layer outermost from the opaque support. In addition, this transparent support also contains a neutralizing layer and a timing layer, as described above, underneath the dye image-receiving layer.

In another embodiment of the invention, the neutralizing layer and a timing layer as described above is located underneath the photosensitive layer or layers. In that embodiment, the photographic element would comprise a support having thereon, in sequence, a neutralizing layer and a timing layer, as described above, and at least one photosensitive silver halide emulsion layer having associated therewith a dye image-providing material. A dye image-receiving layer would be provided on a second support with the processing composition being applied therebetween. This format could either be integral, as described above, or peel-apart such as the two sheet image transfer elements, described previously.

Another embodiment of the invention uses the image-reversing technique disclosed in British Patent 904,364 page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

A process for producing a photographic transfer image in color according to the invention from an imagewise exposed photosensitive element comprising a support having thereon at least one photosensitive silver halide emulsion layer having associated therewith a dye image-providing material comprises treating the element with an alkaline processing composition in the presence of a silver halide developing agent to effect development of each of the exposed silver halide emulsion layers. The processing composition contacts the emulsion layer or layers prior to contacting a neutralizing layer and a timing layer as described above. An imagewise distribution of dye image-providing material is thus formed as a function of development, and at least a portion of it diffuses to a dye image-receiving layer to provide the transfer image.

The film unit or assemblage of the present invention is used to produce positive images in single or multicolors. In a three-color system, each silver halide emulsion layer of the film assembly will have associated therewith a dye image-providing material which prossesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, catechol compounds, and 3-pyrazolidinone compounds as disclosed in column 16 of U.S. Pat. No. 4,358,527, issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In the invention, dye image-providing materials can be used which produce diffusible dye images as a function of development. Either conventional negative-working or direct-positive silver halide emulsions are employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted, negative-working RDR's. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 and 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric inter-layers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbition. Suitable materials and their functioning are disclosed on pages 22 and 23 of the July 1974 edition of *Research Disclosure,* and pages 35 through 37 of the July 1975 edition of *Research Disclosure,* the disclosures of which are here incorporated by reference.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three pirmary regions of the spectrum can be disposed as a single segmented layer, e.g., as by the use of microvessels, as described in Whitmore U.S. Patent application Ser. No. 184,714, filed Sep. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

*Research Disclosure* is a publication of Industrial Opportunities Ltd.; Homewell, Havant; Hampshire, P09 1EF, United Kingdom.

The term "nondiffusing" used herein has the meaning commonly applied to the term in photography and denotes materials that for all practical purposes do not migrate or wander through organic colliod layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1–Sensitometric Tests (A) A control cover sheet of the type described in U.S. Pat. No. 4,029,849 of Abel was prepared by coating the following layers in the order recited on a transparent poly(ethylene terephthalate) film support:

(1) neutralizing layer of poly (n-butyl acryl-ate-co-acrylic acid) (30:70 wt. ratio) equivalent to 140 meq. acid/$m^2$; and (2) timing layer of a physical mixture of the following two polymers:

(a) cellulose acetate (40% acetyl at 14.4 g/$m^2$, and (b) poly(styrene-co-maleic anhydride (1:1 wt. ratio) (Lytron ® Monsanto) at 0.32 g/$m^2$.

(B) Another control cover sheet of the type described in U.S. Pat. No. 4,229,516 of Abel was prepared by coating the following layers in the order recited on a transparent poly(ethylene terephthalate) film support:

(1) neutralizing layer of poly (n-butyl acrylate-co-acrylic acid) (30:70 weight ratio) equivalent to 140 meq. acid/$m^2$; and (2) timing layer of a 1:1 physical mixture of the following two polymers two polymers coated from an organic solvent at 3.2 g/$m^2$:

(a) poly(acrylonitrile-co-vinylidene chloride-co-acrylic acid) (weight ratio 14/79/7); and (b) a carboxy-ester-lactone formed by cyclization of a vinyl acettae-maleic anhydride copolymer in the presence of 1-butanol to produce a partial butyl ester, ratio of acid:ester of 15:85.

(C) A cover sheet containing a timing layer according to the invention was prepared similar to (A) except that the timing layer was a physical mixture of the following two polymers coated from 2-butanone solvent at 4.3 g/$m^2$:

(a) poly(acrylonitrile-co-vinylidene chloride-co-acrylic acid) (95%) in a wt. ratio of 14/79/7 (4.1 g/$m^2$) and (b) poly(styrene-co-maleic anhydride) (5%) in a 1:1 wt. ratio (Lytron ® Monsanto) (0.22 g/$m^2$).

(D) A cover sheet containing a timing layer according to the invention was prepared similar to A) except that the timing layer was a physical mixture of the following two polymers coated from 2-butanone solvent at 4.3 g/$m^2$:

(a) poly(acrylonitrile-co-vinylidene chloride-co-acrylic acid) (92%) in a wt. ratio of 14/79/7 (4.0 g/$m^2$) and (b) poly(ethylene-co-maleic anhydride) (8%) in a 1:1 wt. ratio (Monsanto Resin EMA-31 ®) (0.34 g/$m^2$).

(E) A cover sheet containing a timing layer according the invention was prepared similar to (A) except that the timing layer was a physical mixture of the following two polymers coated from acetone solvent at 4.3 g/$m^2$:

(a) poly(acrylonitrile-co-vinylidene chloride-co-acrylic acid) (85%) in a wt) ratio of 14/79/7 (3.7 g/$m^2$) and (b) poly(vinyl acetate-co-maleic anhydride) (15%) in a 1:1 wt. ratio (0.65 g/$m^2$).

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate .$6H_2O$ (0.58) and gelatin (1.1);

(2) image-receiving layer of poly(4-vinylpyridine) (2.2) and gelatin (2.2);

(3) reflecting layer of titanium dioxide (18) and gelatin (2.8);

(4) opaque layer of carbon black (1.9) and gelatin (1.3);

(5) interlayer of gelatin (1.2);

(6) red-sensitive, negative-working silver boromoiodide emulsion (1.4 silver), gelatin (1.5), cyan positive-working, redox dye-releaser (PRDR) (0.55), incorporated reducing agent (IRA) (0.29), and inhibitor (0.02);

(7) interlayer of gelatin (1.1), scavenger (0.65) and quinone (0.49);

(8) green-sensitive, negtive-working, silver bromoiodide emulsion (1.4 silver), gelatin (1.6), magenta PRDR (0.58), incorporated reducing agent IRA (0.29), and inhibitor (0.007);

(9) interlayer of gelatin (1.1), scavenger (0.65) and quinone (0.49);

(10) blue-sensitive, negative-working silver bromoiodide emulsion (1.4 silver), gelatin (2.2), yellow PRDR (0.46), incorporated reducing agent IRA (0.45), and inhibitor (0.007); and

(11) overcoat layer of gelatin (0.98).

CYAN PRDR

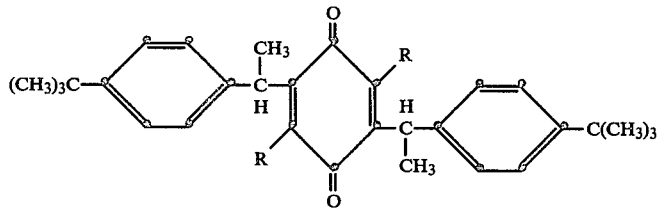

Where R =

-continued
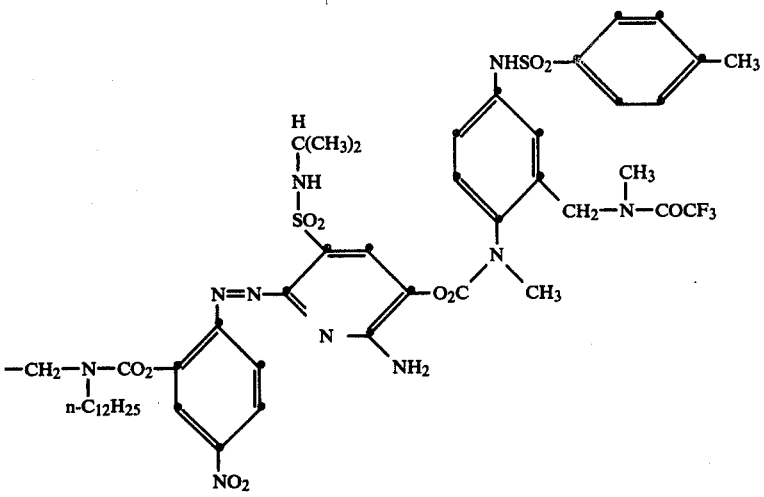
Dispersed in diethyllauramide (PRDR:solvent 2:1)
MAGENTA PRDR
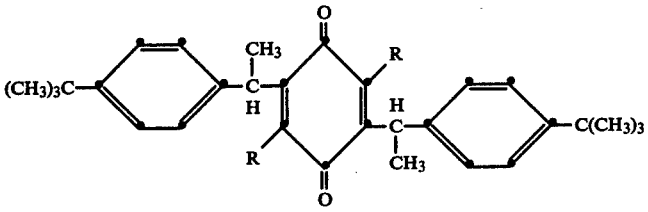
Where R =
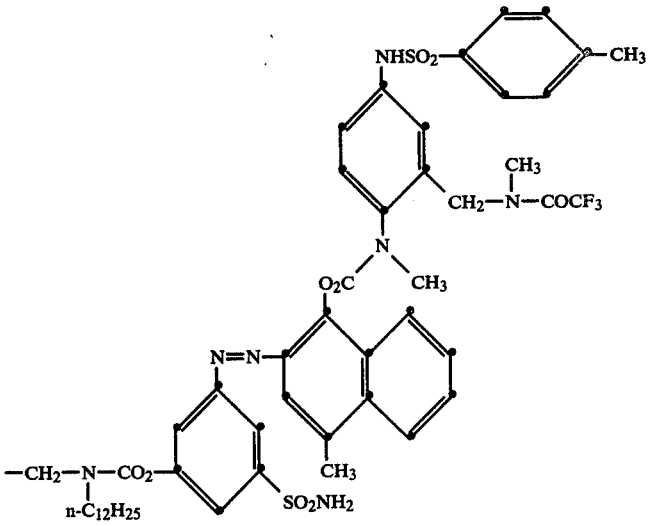
Dispersed in diethyllauramide (PRDR:solvent 1:1)
YELLOW PRDR
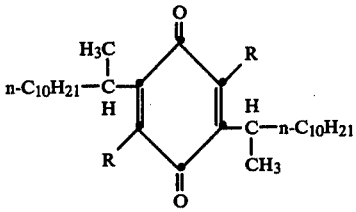

-continued

Where R =

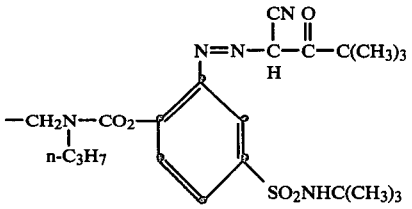

Dispersed in diethyllauramide (total solid:solvent 2:1)

IRA

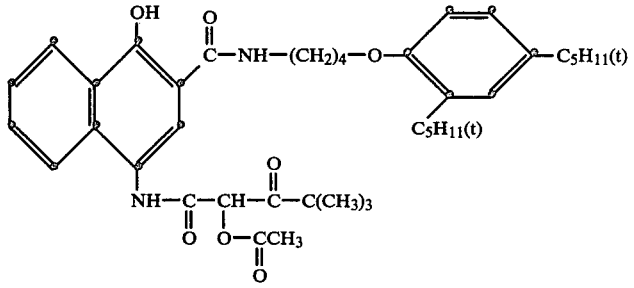

Dispersed in diethyllauramide (total solid:solvent 2:1)

INHIBITOR

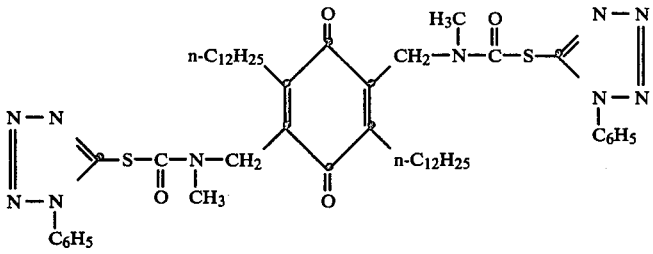

Dispersed in diethyllauramide (total solid:solvent 2:1)

SCAVENGER

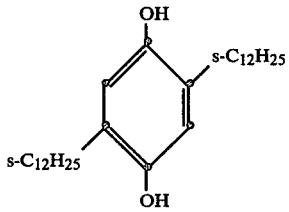

QUINONE

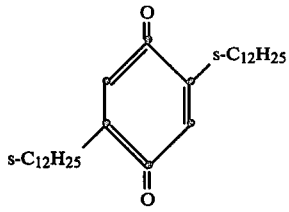

Samples of the imaging-receiver element were exposed in a sensitometer through a graduated density test object to yield a neutral at a Status A density of approximately 1.0. The exposed samples were then processed at about 15.6° C. (60° F.), 22.2° C. (72° F.) and 36.8° C. (100° F.) by rupturing a pod containing the viscous processing composition described below between the imaging-receiver element and the cover sheets described above, by using a pair of juxtaposed rollers to provide a processing gap of about 65 μm.

The processing composition was as follows:

52 g: potassium hydroxide
3.4 g: sodium hydroxide
12 g: 4-methyl-4-hydroxymethyl-1-p-tolyl-3-pyrazolidinone
10 g: ethylenediaminetetraacetic acid, disodium salt dihydrate
0.5 g: lead oxide
2 g: sodium sulfite
2.2 g: Tamol SN® dispersant
5 g: potassium bromide
56 g: carboxymethylcellulose
172 g: carbon water to 1 liter The following sensitometric results were obtained within 24 hours. The TLB values were determined as described in Example 2 of U.S. Pat. No. 4,229,516 of Abel.

TABLE 1

| Cover Sheet | TLB (sec) | | Density (15.6° C./22.2° C./36.8° C.) $D_{min}$ | $D_{max}$ | ΔD (15.6° C. to 36.8° C.) $\Delta D_{min}$ | $\Delta D_{max}$ |
|---|---|---|---|---|---|---|
| A (Control) | 365 | R | 0.13/0.13/0.15 | 2.1/1.9/1.8 | +0.02 | −0.3 |
| | | G | 0.11/0.11/0.12 | 1.8/1.7/1.6 | +0.01 | −0.2 |
| | | B | 0.16/0.16/0.17 | 2.0/1.9/1.9 | +0.01 | −0.1 |
| B (Control) | 375 | R | 0.13/0.13/0.14 | 2.1/2.0/1.6 | +0.01 | −0.5 |
| | | G | 0.11/0.11/0.11 | 1.9/1.8/1.5 | 0 | −0.4 |
| | | B | 0.16/0.16/0.16 | 2.0/2.0/1.8 | 0 | −0.2 |
| C | 315 | R | 0.13/0.13/0.14 | 2.1/1.8/1.6 | +0.01 | −0.5 |
| | | G | 0.11/0.11/0.11 | 1.8/1.6/1.4 | 0 | −0.4 |
| | | B | 0.16/0.16/0.16 | 2.0/1.9/1.9 | 0 | −0.1 |
| D | 305 | R | 0.13/0.13/0.13 | 2.1/2.0/1.7 | 0 | −0.4 |
| | | G | 0.12/0.11/0.11 | 1.9/1.8/1.5 | −0.01 | −0.4 |
| | | B | 0.16/0.16/0.16 | 2.0/2.0/1.9 | 0 | −0.1 |
| E | 410 | R | 0.13/0.13/0.15 | 2.1/1.9/1.6 | 0 | −0.5 |
| | | G | 0.12/0.12/0.12 | 1.9/1.8/1.4 | 0 | −0.5 |
| | | B | 0.18/0.18/0.18 | 2.0/1.9/1.9 | 0 | −0.1 |

The above results indicate that at process temperatures from 15.6° C. (60° F.) to 36.8° C. (100° F.), equivalent sensitometric results are obtained with the timing layers of my invention as compared to two prior art timing layers. The disadvantages of these prior art timing layers as compared to the timing layer of my invention were discussed above.

EXAMPLE 2

TLB Variability (A) A cover sheet similr to (C) of Example 1 was prepared except that the amount of poly(styrene-co-maleic anhydride) in the polymer mixture was 17.5%, 15% and 12.5%. The TLB values were determined in the manner described in Example 2 of U.S. Pat. No. 4,229,516 of Abel. The following results were obtained:

| poly(styrene-co-maleic anhydride) % of polymer mixture | TLB (sec) |
|---|---|
| 17.5 | 255 |
| 15 | 365 |
| 12.5 | 465 |

(B) A cover sheet similar to (D) of Example 1 was prepared except that the amount of poly(ethylene-co-maleic anhydride) in the polymer mixture was 8%, 10%, 12.5% and 15%. The TLB values were determined as in (A). The following results were obtained:

| poly(ethylene-co-maleic anhydride) % of polymer mixture | TLB (sec) |
|---|---|
| 15 | 128 |
| 12.5 | 170 |
| 10 | 238 |
| 8 | 305 |

(C) A cover sheet similar to (E) of Example 1 was prepared except that the amount of poly(vinyl acetate-co-maleic anhydride) in the polymer mixture was 11%, 13% and 5%. The TLB values were determined as in (A). The following results were obtained:

| poly(vinyl acetate-co-maleic anhydride) % of polymer mixture | TLB (sec) |
|---|---|
| 15 | 350 |
| 13 | 468 |
| 11 | 615 |

These results indicate that the TLB time of my timing layers can be varied over a wide range merely by varying the ratio of components of the polymer mixture. As less of the maleic anhydride copolymer is used, the TLB time becomes longer. This feature is very useful in optimizing the sensitometric values for a given system.

EXAMPLE 3

Activation Energies

A cover sheet (C') containing a timing layer according to the invention was prepared similar to cover sheet C of Example 1, exept that the maleic anhydride copolymer b) was present at 0.32 g/m$^2$ (total coverage was still 4.3 g/m$^2$).

A cover sheet (D') containing a timing layer according to the invention was prepared similar to cover sheet D of Example 1, except that the maleic anhydride copolymer (b) was present at 0.65 g/m$^2$ (total coverage was still 4.3 g/m$^2$).

Cover sheets similar to A, B and E of Example 1 were also prepared.

Activation energies, Ea, for the timing layers of the above cover sheets were estimated by obtaining TLB times as described in Example 2, from 16° to 38° C. and determining the slope of a plot of TLB time versus 1/T (°K) as described in Hannie et al U.S. Pat. No. 4,061,496. The following results were obtained:

| Cover sheet | Ea (kcal/mole) |
|---|---|
| A (control) | ≃10 |
| B (control) | ≃20 |
| C' | ≃11 |
| D' | ≃14 |
| E | ≃17–20 |

The above results indicate that the Ea of the timing layers according to the invention are intermediate those of the two prior art control timing layers. This provides a useful technique in matching the Ea to the requirements for a particular system.

EXAMPLE 4

TLB Comparative Tests (F) A comparative cover sheet was prepared by coating the following layers in the order recited on a transparent poly(ethylene terephthalte) film support:

(1) neutralizing layer of poly(n-butyl acrylate-co-acrylic acid) (30:70 wt. ratio) equivalent to 140 meq./m$^2$), and (2) a solvent-coated timing layer of poly(styrene-co-maleic anhydride) in a 1:1 wt. ratio (Lytron® Monsanto) at the coverages indicated in the Table below.

(G) Another comparative cover sheet was prepared similar to (F) except that the timing layer was a solvent coating of poly(acrylonitrile-co-vinylidene chloride-co-acrylic acid) (wt. ratio of 14/79/7) at 0.41 g/m$^2$.

The TLB times for these cover sheets were determined in the manner described in Example 2 of U.S. Pat. No. 4,229,516 of Abel. The following results were obtained:

| Cover Sheet | Timing Layer | Timing Layer Coverage (g/m2) | TLB (sec) |
|---|---|---|---|
| F | poly(styrene-co-maleic anhydride) | 0.22 | ≃10 |
| | | 0.43 | ≃10 |
| | | 4.3 | ≃10 |
| G | poly(acrylonitrile-co-vinylidene chloride-co-acrylic acid) | 0.41 | >1500 |

The above results indicate that the maleic anhydride copolyer alone does not function as a useful timing layer. Regardless of the timing layer coverage, alkali penetrated all of those coatings within 10 sec. as measured by the thymolphthalein indicator sheet. Thus the solvent coatings of poly(styrene-co-maleic anhydride) alone were too permeable and hydrophilic to be considered a useful timing layer.

The above results also indicate that the solvent coating of the vinylidene chloride terpolymer alone does not function as a useful timing layer either. Since no significant penetration of alkali was observed within 25 minutes (no color change in the thymolphthalein indicator sheet), it is evident that this polymer is too impermeable and hdyrophobic to be a useful timing layer.

When these two polymers are mixed together in accordance with my invention, however, as shown in part A of Example 2 above, a useful timing layer is obtained.

Other polymers were attempted to be combined with the vinylidene chloride terpolymer described above but did not provide any useful results. For example, carboxyl-containing polymers such as poly-(ethyl acrylate-co-acrylic acid) (30:70 wt. ratio) were not compatible when mixed with the vinylidene chloride terpolymer described above in a 2-butanone solvent, i.e., they did not form a continuous film upon coating. Other polymers such as poly(vinyl acetate) appeared to be compatible with the vinylidene terpolymer described above and were coated to provide what appeared to be a uniform coating. However testing with a thymolphthalein indicator sheet (TLB test described above) showed a very nonuniform, blotchy breakdown which indicated a gross incompatibility of the polymer mixture when dry. Only the maleic anhydride copolymers described above gave useful results when mixed with the vinylidene chloride terpolymers, as described above.

The invention has been described in detail with particular reference to preferred embodiments thereof, but it will be understood that variations and modifications can be effected within the spirit and scope of the invention.

What is claimed is

1. In a photographic assemblage comprising:

(a) a photosensitive element comprising a support having thereon at least one photosensitive silver halide emulsion layer having associated therewith a dye image-providing material;

(b) a dye image-receiving layer;

(c) a neutralizing layer for neutralizing an alkaline processing composition; and (d) a timing layer located between said neutralizing layer and said dye image-receiving layer;

the improvement wherein said timing layer comprises a physical mixture of the following two polymers:

(i) a first polymer comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride; and (ii) a second polymer comprising from about 20 to about 70 percent by weight of recurring units of maleic anhydride and from about 80 to about 30 percent by weight of recurring units of a vinyl ester or an alkene;

said second polymer being present at a concentration of from about 2 to about 20 percent by weight of said mixture.

2. The assemblage of claim 1 which also contains an alkaline processing composition and means containing same for discharge within said assemblage.

3. The assemblage of claim 2 wherein said ethylenically unsaturated monomer comprises acrylonitrile and said ethylenically unsaturated carboxylic acid comprises either acrylic acid or itaconic acid.

4. The assemblage of claim 2 wherein said vinyl ester is vinyl acetate and said alkene is either ethylene or styrene.

5. The assemblage of claim 2 wherein:

(i) said first polymer comprises from about 5 to about 35 percent by weight of recurring units of acrylonitrile, from about 2 to about 10 percent by weight of recurring units of acrylic acid, and from about 55 to about 85 percent by weight of recurring units of vinylidene chloride; and (ii) said second polymer comprises from about 20 to about 70 percent by weight of recurring units of maleic anhydride and from about 80 to about 30 percent by weight of recurring units of styrene.

6. The assemblage of claim 2 wherein:

(a) said dye image-receiving layer is located in said photosensitive element between said support and said silver halide emulsion layer; and (b) said assemblage also includes a transparent cover sheet over the layer outermost from said support.

7. The assemblage of claim 6 wherein said transparent cover sheet is coated with, in sequence said neutralizing layer and said timing layer.

8. The assemblage of claim 7 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

9. The assemblage of claim 2 wherein said support of said photosensitive element is opaque, and said dye image-receiving layer is located on a separate transparent support superposed on the layer outermost from said opaque support.

10. The assemblage of claim 9 wherein said transparent support has thereon, in sequence, said neutralizing layer, said timing layer and said dye image-receiving layer.

11. The assemblage of claim 9 wherein said opaque support has thereon, in sequence, said neutralizing layer, said timing layer and said silver halide emulsion layer.

12. The assemblage of claim 2 wherein said dye image-providing material is a positive-working redox dye-receiver.

13. The assemblage of claim 12 wherein said positive-working redox dye-releaser is a quinone redox dye-releaser and said photosensitive element contains an incorporated reducing agent.

14. The assemblage of claim 13 wherein said quinone redox dye-releaser has the formula:

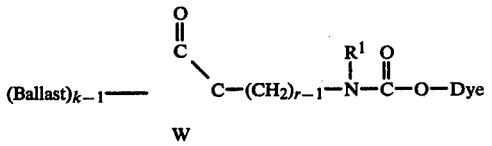

wherein:

Ballast is an organic ballasting radical of such molecular size and configuration as to render said compound nondiffusible in said photosensitive element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is an organic dye or dye precursor moiety.

15. The assemblage of claim 2 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

16. An integral photographic assemblage comprising:

(a) a photosensitive element comprising a transparent support having thereon the following layers in sequence: a dye image-receiving layer; an alkaline solution-permeable, light-reflective layer; an alkaline solution-permeable, opaque layer; a red-sensitive silver halide emulsion layer having a cyan redox dye-releaser associated therewith; a green-sensitive silver halide emulsion layer having a magenta redox dye-releaser associated therewith; and a blue-sensitive silver halide emulsion layer having a yellow redox dye-releaser associated therewith;

(b) a transparent cover sheet superposed over said blue-sensitive silver halide emulsion layer and comprising a transparent support having thereon, in sequence, a neutralizing layer and a timing layer comprising a physical mixture of the following two polymers:

(i) a first polymer comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride; and (ii) a second polymer comprising from about 20 to about 70 percent by weight of recurring units of maleic anhydride and from about 80 to about 30 percent by weight of recurring units of a vinyl ester or an alkene;

said second polymer being present at a concentration of from about 2 to about 20 percent by weight of said mixture; and (c) a rupturable container containing an alkaline processing composition and an opacifying agent, said container being so positioned during process of said assemblage that a compressive force applied to said container will effect a discharge of the container's contents between said transparent cover sheet and said blue-sensitive silver halide emulsion layer;

said assemblage containing a silver halide developing agent.

17. The assemblage of claim 16 wherein said ethylenically unsaturated monomer comprises acrylonitrile and said ethylenically unsaturated carboxylic acid comprises either acrylic acid or itaconic acid.

18. The assemblage of claim 16 wherein said vinyl ester is vinyl acetate and said alkene is either ethylene or styrene.

19. The assemblage of claim 16 wherein:

(i) said first polymer comprises from about 5 to about 35 percent by weight of recurring units of acrylonitrile, from about 2 to about 10 percent by weight of recurring units of acrylic acid, and from about 55 to about 85 percent by weight of recurring units of vinylidene chloride; and (ii) said second polymer comprises from about 20 to about 70 percent by weight of recurring units of maleic anhydride and from about 80 to about 30 percent by weight of recurring units of styrene.

20. A cover sheet adapted to be permeated by an alkaline processing composition comprising a transparent support having thereon a neutralizing layer and a timing layer comprising a physical mixture of the following two polymers:

(i) a first polymer comprising from about 5 to about 35 percent by weight of recurring units of an ethylenically unsaturated monomer, from about 0 to about 20 percent by weight of recurring units of an ethylenically unsaturated carboxylic acid, and from about 55 to about 85 percent by weight of recurring units of vinylidene chloride; and (ii) a second polymer comprising from about 20 to about 70 percent by weight of recurring units of maleic anhydride and from about 80 to about 30 percent by weight of recurring units of a vinyl ester or an alkene;

said second polymer being present at a concentration of from about 2 to about 20 percent by weight of said mixture.

21. The cover sheet of claim 20 wherein said ethylenically unsaturated monomer comprises acrylonitrile and said ethylenically unsaturated carboxylic acid comprises either acrylic acid or itaconic acid.

22. The cover sheet of claim 20 wherein said vinyl ester is vinyl acetate and said alkene is either ethylene or styrene.

23. The cover sheet of claim 20 wherein:

(i) said first polymer comprises from about 5 to about 35 percent by weight of recurring units of acrylonitrile, from about 2 to about 10 percent by weight of recurring units of acrylic acid, and from about 55 to about 85 percent by weight of recurring units of vinylidene chloride; and (ii) said second polymer comprises from about 20 to about 70 percent by weight of recurring units of maleic anhydride and from about 80 to about 30 percent by weight of recurring units of styrene.

* * * * *